US006868982B2

(12) United States Patent
Gordon

(10) Patent No.: US 6,868,982 B2
(45) Date of Patent: Mar. 22, 2005

(54) INSULATED SHIPPING CONTAINER AND METHOD OF MAKING THE SAME

(75) Inventor: Lawrence A. Gordon, Southborough, MA (US)

(73) Assignee: Cold Chain Technologies, Inc., Holliston, MA (US)

( * ) Notice: Subject to any disclaimer, the term of this patent is extended or adjusted under 35 U.S.C. 154(b) by 0 days.

(21) Appl. No.: 10/006,748

(22) Filed: Dec. 5, 2001

(65) Prior Publication Data

US 2003/0102317 A1 Jun. 5, 2003

(51) Int. Cl.[7] ..... A47J 39/00

(52) U.S. Cl. ..... 220/592.23; 220/592.25; 220/592.26

(58) Field of Search ..... 220/592.23, 592.24, 220/592.25, 592.26; 383/110; 206/524

(56) References Cited

U.S. PATENT DOCUMENTS

| | | | | |
|---|---|---|---|---|
| 3,613,933 A | | 10/1971 | Rastatt et al. | |
| 3,799,386 A | | 3/1974 | Madalin et al. | |
| 4,136,141 A | | 1/1979 | Bauer et al. | |
| 4,368,819 A | | 1/1983 | Durham | |
| 4,658,567 A | | 4/1987 | Arada | |
| 4,671,424 A | | 6/1987 | Byrns | |
| 4,829,741 A | * | 5/1989 | Langen | 53/122 |
| 4,923,077 A | | 5/1990 | Van Iperen et al. | |
| 5,186,350 A | | 2/1993 | McBride | |
| 5,261,554 A | | 11/1993 | Forbes | |
| 5,897,017 A | | 4/1999 | Lantz | |
| 6,257,764 B1 | | 7/2001 | Lantz | |
| 6,325,281 B1 | * | 12/2001 | Grogan | 229/103.11 |

* cited by examiner

*Primary Examiner*—Stephen Castellano
(74) *Attorney, Agent, or Firm*—Kriegsman & Kriegsman

(57) ABSTRACT

Insulated shipping container and method of making the same. In a preferred embodiment, the insulated shipping container comprises an outer box, an insulated insert, an inner box and a closure member. The outer box, which is preferably made of corrugated fiberboard, comprises a rectangular prismatic cavity bounded by a plurality of rectangular side walls, a closed bottom end, and top closure flaps. The insulated insert is snugly, but removably, disposed within the outer box and is shaped to define a rectangular prismatic cavity bounded by a bottom wall and a plurality of rectangular side walls, the insulated insert having an open top end. The insulated insert is made of a foamed polyurethane body to which on all sides, except its bottom, a thin, flexible, unfoamed polymer bag is integrally bonded. The bag is a unitary structure having a generally uniform rectangular shape, the bag being formed by sealing shut one end of a tubular member with a transverse seam and forming longitudinal creases extending from opposite ends of the seam. The inner box, which is snugly, but removably, disposed within the insert, is preferably made of corrugated fiberboard and is shaped to include a rectangular prismatic cavity bounded by a plurality of rectangular side walls and a closed bottom end, the top end thereof being open. The closure member is a thick piece of foam material snugly, but removably, disposed in the open end of the inner box.

10 Claims, 7 Drawing Sheets

INSULATED SHIPPING CONTAINER AND METHOD OF MAKING THE SAME

BACKGROUND OF THE INVENTION

The present invention relates generally to insulated shipping containers and relates more particularly to insulated shipping containers of the type which are formed at least in part of foamed polymer material.

Conventional insulated shipping containers of the so-called box-within-a-box configuration are well-known. These conventional box-within-a-box containers typically have an outer box formed of corrugated cardboard and a smaller, open-topped, inner box also formed of corrugated cardboard, the outer and inner boxes defining a void space therebetween. During manufacture of such shipping containers, the void space is filled with a foamed-in-place polymer material, said foamed-in-place polymer material typically being a light-to-medium density foamed polyurethane material.

Typically, the manufacture of such box-within-a-box containers comprises mounting the inner box, in an inverted position, over a manufacturing fixture having an upstanding plug member. Next, the outer box is inverted onto the manufacturing fixture with its top closure flaps turned outward, and its bottom closure flaps opened. The manufacturing fixture includes an outer movable wall structure which supports the side walls of the outer box. The polymer material in a liquid pre-foamed condition is then sprayed or poured into the void space between the two boxes and is allowed to foam in place. The foaming of the polymer material takes a sufficient period of time that the bottom closure flaps of the box may be closed before the foam fills the entirety of the void space, and a lid is closed over these closure flaps to support the box against the internal pressure created by the foaming polymer. As this polymer material foams in place, it bonds to both the inner and outer boxes and exerts a considerable pressure against both the inner and outer boxes. In fact, were it not for the support to these boxes provided by the manufacturing fixture, the boxes would be seriously distorted or destroyed by the foam pressure. After an additional period of time (total time of ten minutes or less), the foam hardens sufficiently that the substantially finished shipping container may be removed from the fixture.

In using such conventional insulated shipping containers, it is common for one or more articles being shipped therein to be inserted into the inner box of the container, together with dry ice or other temperature stabilizing packs and packing material. A form-fitting block of comparatively thick, open-cell foam is then inserted into the opening of the inner box. This open-cell foam serves as a thermal insulator and prevents the infusion of ambient air into the inner box and the escape of temperature-controlled air from within the inner box. Next, the top closure flaps of the outer box are closed and taped, and the shipping container is ready for shipment with the attachment of a shipping label thereto.

Unfortunately, the above-described conventional insulated shipping container has certain shortcomings. One significant shortcoming is that the materials of the container are not recyclable because the foamed polymer material bonds directly to the inner and outer cardboard boxes and cannot thereafter easily be separated therefrom. This shortcoming is an ever-increasing concern as more and more states and countries require that shipping materials which have destinations within their jurisdictions be recyclable or otherwise be subject to a penalty tax or fee for special disposal. Moreover, if the outer box becomes damaged or otherwise marked, it cannot be replaced in such a way as to permit the container to be reused.

One suggestion that has been proposed to allow the separation of foamed polymer material from the cardboard boxes of the aforementioned type of container has been to simply bunch a flat sheet of plastic film within the outer box and over the inner box before the foam polymer material in a liquid form is injected. However, the bunching of a flat sheet of plastic film in the above-described manner typically results in the formation of many folds and fissures in the excess sheet material. These many folds and fissures often form many airflow pathways through which temperature-controlled air can escape from the container, and through which ambient air can enter. Also, as can readily be appreciated, the aforementioned bunching of the plastic film typically results in variations in the thickness of the insulative foamed polymer in the vicinity of said folds and fissures. As a result, some containers made by this method possess one or more areas where the insulating foam is too thin and where, in effect, the contents are exposed to "hot spots" or "cold spots" of ambient air leaking into the container. Because one potential application of insulated shipping containers is in the transport of temperature-sensitive medical specimens or materials which are irreplaceable or critical to the well-being of a patient, the risks associated with using a shipping container made using a bunched flat sheet in the above-described manner are often too great.

In U.S. Pat. No. 5,897,017, inventor Lantz, which issued Apr. 27, 1999, and in U.S. Pat. No. 6,257,764, inventor Lantz, which issued Jul. 10, 2001, both of which are incorporated herein by reference, there is disclosed a recyclable insulated shipping container that addresses many of the above-described shortcomings associated with the use of a bunched flat sheet to separate foamed polymer material from a cardboard box. More specifically, the two Lantz patents above disclose an insulated shipping container that includes a specially-designed plastic bag into which the foam polymer material in a liquid form is injected to yield a body of foamed polymer material substantially contained within the specially-designed plastic bag, the body of foamed polymer material defining a chamber therein and an opening outwardly from the chamber surrounded by a transition surface, the specially-designed plastic bag including a rectangular end portion and a curved transition section extending from the rectangular end portion to a transverse line at which the bag defines a hoop dimension sufficient to allow the bag to extend across the transition surface of the body of foamed polymer material.

Because of its tailored shape, the Lantz bag has a minimal number of folds and fissures and, therefore, results in a body of foamed polymer material that is substantially uniformly thick and substantially free of fissures. Unfortunately, as can readily be appreciated, because of its unusual shape, the Lantz bag can be expensive to manufacture, thereby resulting in a shipping container that is expensive to manufacture.

SUMMARY OF THE INVENTION

It is an object of the present invention to provide a novel insulated shipping container.

It is another object of the present invention to provide an insulated shipping container as described above that addresses at least some of the shortcomings associated with existing insulated shipping containers.

According to one aspect of the present invention, there is provided an insulated shipping container, said insulated shipping container comprising (a) an outer box; (b) an insulated insert, said insulated insert being slidably removably disposed within said outer box; and (c) an inner box, said inner box being slidably removably disposed within said insulated insert.

According to another aspect of the invention, there is provided an insulated shipping container, said insulated shipping container comprising (a) a foamed polymer body shaped to define a rectangular prismatic cavity bounded by four rectangular side walls and a bottom wall, said foamed polymer body having an open top end; and (b) a flexible, un-foamed polymer bag integrally bonded to said foamed polymer body along said rectangular prismatic cavity, said open top end and said four rectangular side walls, said flexible, un-foamed polymer bag having a generally uniform width over its length.

In a preferred embodiment, the insulated shipping container comprises an outer box, an insulated insert, an inner box and a closure member. The outer box, which is preferably made of corrugated fiberboard or corrugated plastic, comprises a rectangular prismatic cavity bounded by a plurality of rectangular side walls, a closed bottom end, and top closure flaps. The insulated insert is snugly, but removably, disposed within the outer box and is shaped to define a rectangular prismatic cavity bounded by a bottom wall and a plurality of rectangular side walls, the insulated insert having an open top end. The insulated insert is made of a foamed polyurethane body to which on all sides, except its bottom, a thin, flexible, unfoamed polymer bag is integrally bonded. The bag is a unitary structure having a generally rectangular shape and a generally uniform width over its length, the bag being formed by sealing shut one end of a tubular member with a transverse seam and forming longitudinal creases extending from opposite ends of the seam. The inner box, which is snugly, but removably, disposed within the insert, is preferably made of corrugated fiberboard or corrugated plastic and is shaped to include a rectangular prismatic cavity bounded by a plurality of rectangular side walls and a closed bottom end, the top end thereof being open. The closure member is a thick piece of foam material snugly, but removably, disposed in the open end of the inner box.

The present invention is also directed to a method of making an insulated shipping container and to an insulated shipping container made by said method.

For purposes of the present specification and claims, relational terms like "top," "bottom," "upper," and "lower" are used to describe the present invention in a context in which the open-end of the storage cavity of the container is facing upwardly. It is to be understood that, by orienting the container such that the storage cavity faces in a direction other than upwardly, the directionality of the invention will need to be adjusted accordingly.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
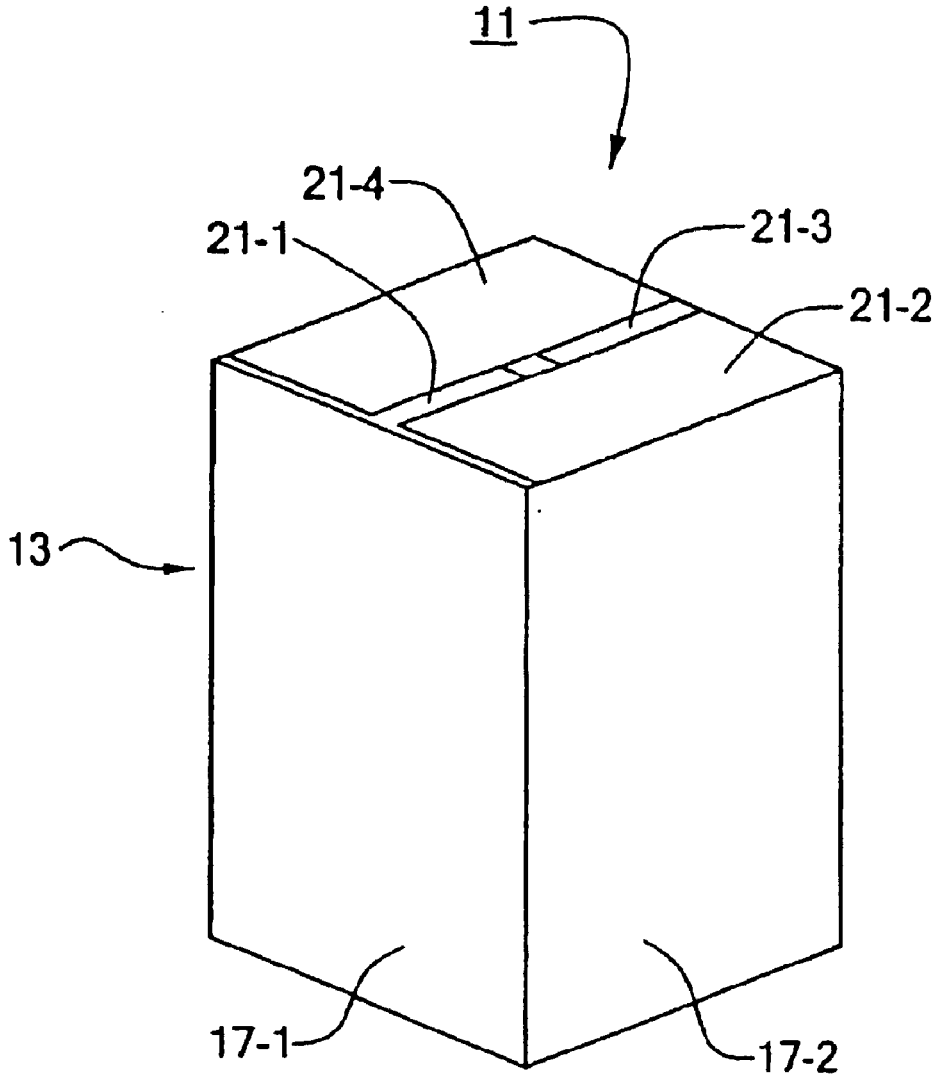
FIG. 1 is a perspective view of a first embodiment of an insulated shipping container constructed according to the teachings of the present invention, the insulated shipping container being shown in a closed state.
Figure 2:
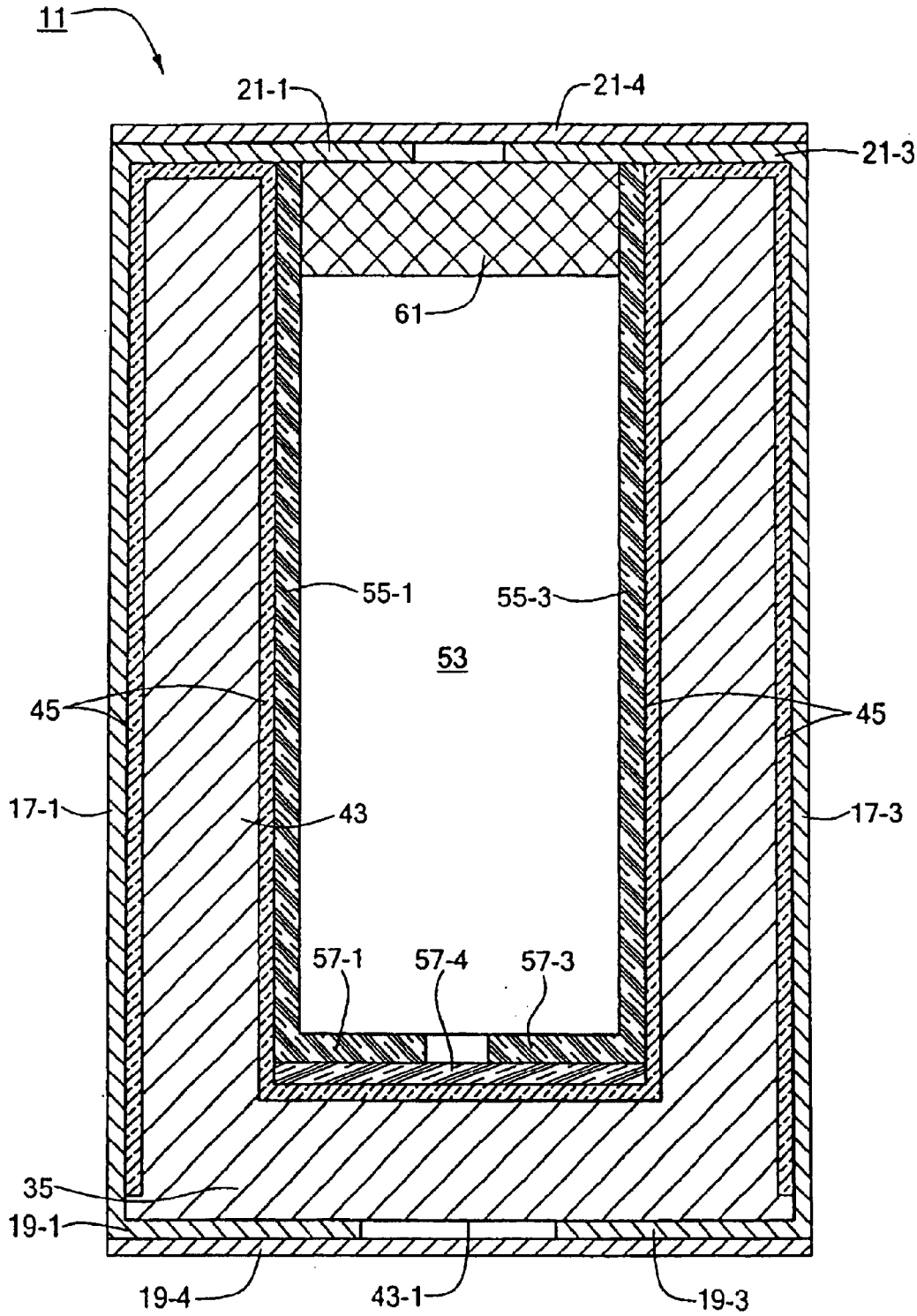
FIG. 2 is a longitudinal section view of the insulated shipping container of FIG. 1.
Figure 3:
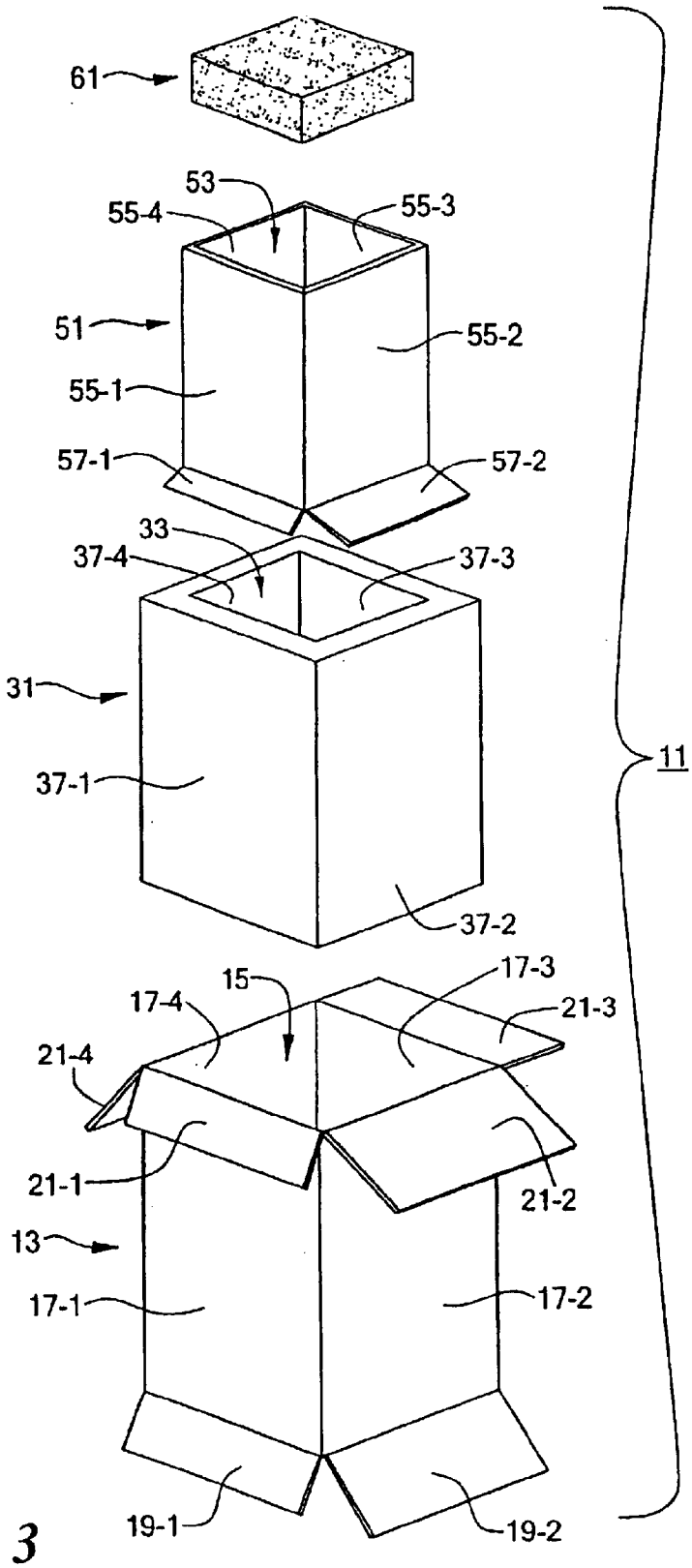
FIG. 3 is a partially exploded perspective view of the insulated shipping container of FIG. 1.

Referring now to FIGS. 1 through 3, there are shown various views of a first embodiment of an insulated shipping container constructed according to the teachings of the present invention, said insulated shipping container being represented generally by reference numeral 11.

Container 11 comprises an outer box 13. Outer box 13, which is preferably a corrugated fiberboard or corrugated plastic box and which may be conventional in construction, comprises a rectangular prismatic cavity 15 bounded by a plurality of rectangular side walls 17-1 through 17-4, a plurality of bottom closure flaps 19-1 and 19-4, and a plurality of top closure flaps 21-1 through 21-4. Adhesive strips of tape or other adhesive means (not shown) may be used to retain in a closed condition bottom closure flaps 19-1 through 19-4 and top closure flaps 21-1 through 21-4.

Referring now to FIGS. 2 and 3, container 11 also comprises an insulated insert 31, insert 31 being slidably removably disposed within cavity 15 of box 13. Insert 31, the details of which will be described below, is shaped to define a rectangular prismatic cavity 33 bounded by a bottom wall 35 and a plurality of rectangular side walls 37-1 through 37-4, insert 31 having an open top end. Insert 31 is appropriately sized and shaped so that its outer side surfaces and bottom surface substantially match the corresponding inside surfaces of outer box 13, with the outside surfaces of side walls 37-1 through 37-4 snugly abutting the inside surfaces of side walls 17-1 through 17-4, respectively, and with the bottom surface of bottom wall 35 seated upon bottom closure flaps 19-1 through 19-4.

Figure 4:
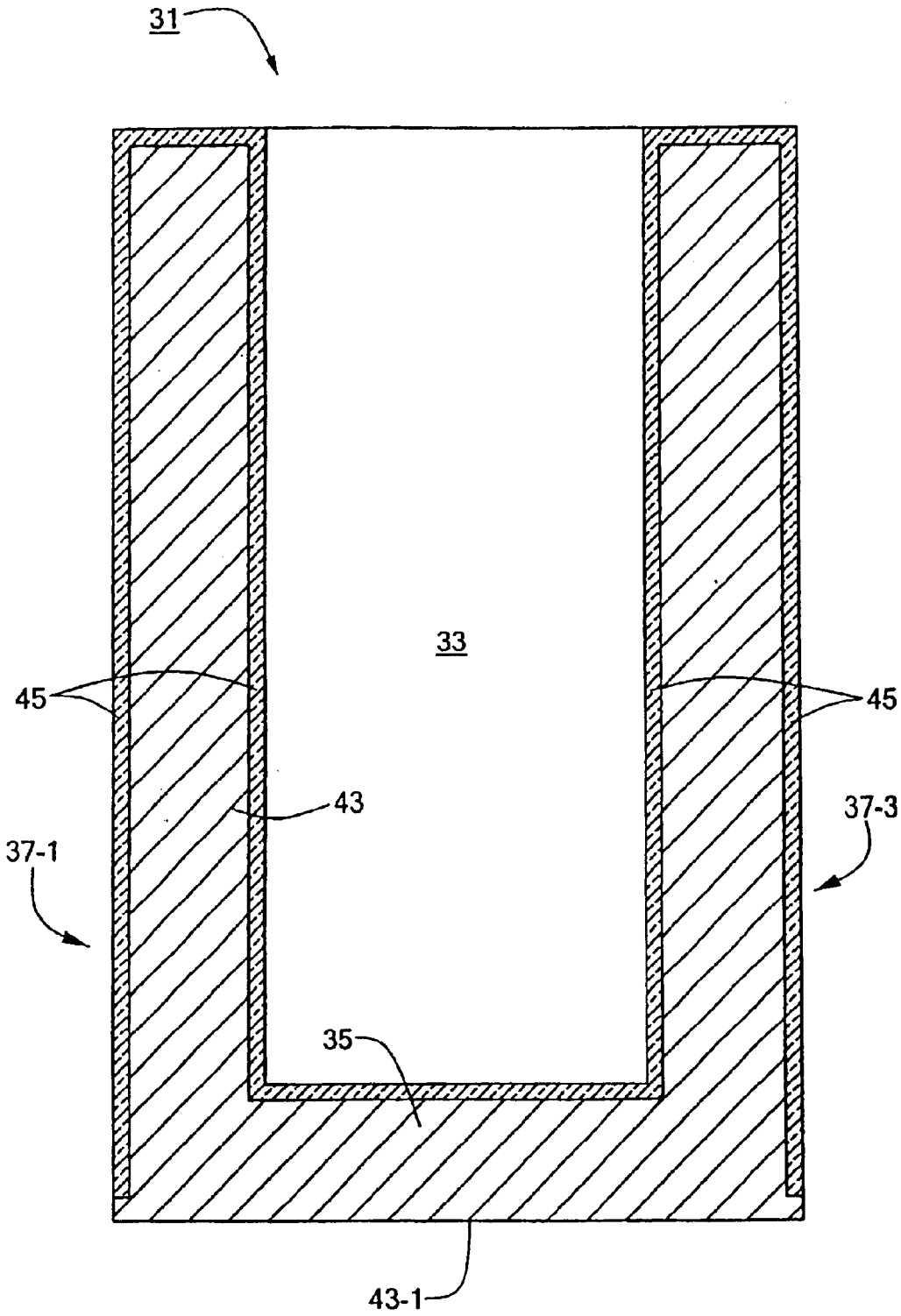
FIG. 4 is a longitudinal section view of the insulated insert shown in FIG. 3.
Figure 5B:
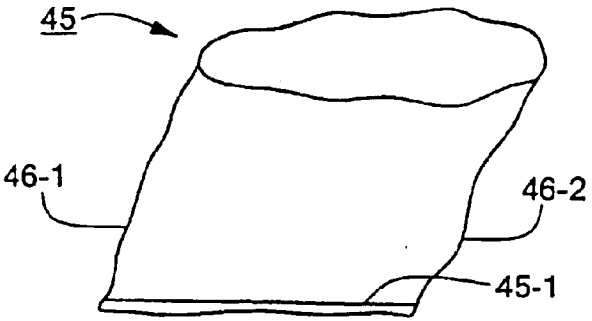
FIGS. 5(*a*) and 5(*b*) are front and perspective views of the plastic bag used in the manufacture of the insulating insert shown in FIG. 3.
Figure 5A:
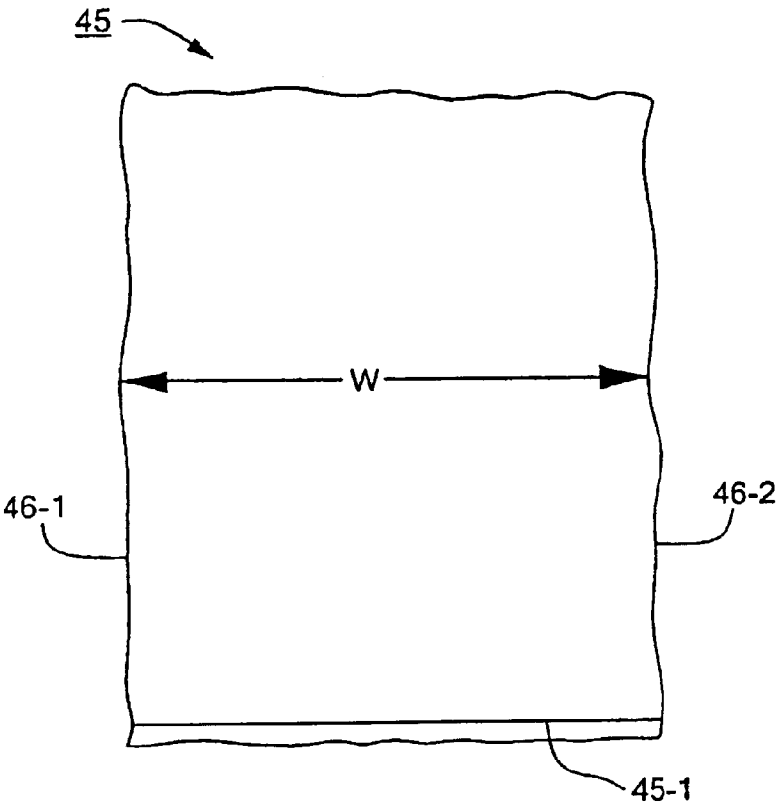

As seen best in FIG. 4, insert 31 comprises a body 43 of foamed polymer material, preferably a foamed polyurethane, more preferably a hydrochlorofluorocarbon (HCFC) polyurethane or a hydrofluorocarbon (HFC) polyurethane, such as an HCFC-22 polyurethane or an HFC-134a polyurethane. Insert 31 also comprises a thin, flexible, non-self-supporting, unfoamed polymer bag 45, bag 45 preferably being made of hexene or a polyethylene (preferably a high density polyethylene). Bag 45 is integrally bonded and conformal to body 43, with bag 45 covering all surfaces of body 43, except for the bottom surface 43-1 of body 43. Front and perspective views of bag 45, prior to its being used to form insert 31, are shown in FIGS. 5(*a*) and 5(*b*), respectively. As can be seen therein, bag 45 is a unitary structure having a generally uniform rectangular shape, bag 45 being made by sealing shut one end of a tubular member with a transverse seam 45-1 and by forming longitudinal creases 46-1 and 46-2 extending from opposite ends of seam 45-1. As can be appreciated, bag 45 has a generally constant width w and uniform inside dimension along its length.

Referring back now to FIGS. 2 and 3, container 11 additionally comprises an inner box 51, inner box 51 being slidably removably disposed within cavity 33 of insert 31. Inner box 51, which is preferably a corrugated fiberboard or corrugated plastic box and which may be conventional in construction, comprises a rectangular prismatic cavity 53 bounded by a plurality of rectangular side walls 55-1 through 55-4 and a plurality of bottom closure flaps 57-1 and 57-4, the top end of inner box 51 being open. Adhesive strips or other adhesive means (not shown) may be used to retain in a closed condition bottom closure flaps 57-1 through 57-4. Box 51 is appropriately sized and shaped so that its outer side surfaces and bottom surface substantially match the corresponding inside surfaces of insert 31, with the outside surfaces of side walls 55-1 through 55-4 snugly abutting the inside surfaces of side walls 37-1 through 37-4, respectively, and with the bottom surface of flaps 57-1 through 57-4 being seated upon the top surface of bottom wall 35.

Container 11 further comprises a closure member 61, closure member 61 being removably mounted within cavity 53 at its open top end. Closure member 61, which may be conventional in structure and composition, is preferably a comparatively thick piece of open-cell foam material cut to a size allowing its light force-fitting by hand into the open end of cavity 53 (while still allowing articles and temperature stabilizers to be stored within the remainder of cavity 53). Because closure member 61 is of an open-cell nature, ambient air does not penetrate therethrough; however, carbon dioxide resulting from the sublimation of dry ice stored within cavity 53 is permitted to escape cavity 53 past the outer edges of member 61.

Although container 11 may be varied in size to suit particular applications, illustrative volumes for cavity 53 of inner box 51 include 1.86 $ft^3$ and 1.45 $ft^3$, and an illustrative thickness for insert 31 is approximately 2 inches.

Container 11 may be made in a manner essentially identical to that used to make insulated shipping container 10 of U.S. Pat. No. 5,897,017 using machine 50 of U.S. Pat. No. 5,897,017, with the following distinctions: First, prior to mounting bag 45 on the plug member of machine 50, inner box 51 (with flaps 57-1 through 57-4 in a closed state) is mounted in an inverted orientation over said plug member. Bag 45 is then mounted over inverted box 51, with seam 45-1 being positioned on top of the inverted box 51. The remainder of bag 45 is then drawn, by hand and/or vacuum, over the remainder of box 51 and is shaped to match the cavity of machine 50 defined by said plug member and the four side walls of machine 50. The open end of bag 45 is then turned over the four side walls of machine 50. Foaming material is then poured into bag 45, thus drawn, machine 50 is covered, and the foaming material is allowed to foam in place and harden. (By contrast with container 10, no unfoamed sheet material is placed over the top of the foaming material in the present embodiment. Also, in the present embodiment, the bottom surface of the cover to machine 50 may be provided with a non-stick surface.) Once the foaming material has hardened, the combination of box 51 and insert 31 is removed from machine 50 and is inserted, right-side-up, into box 13 (with closure flaps 19-1 to 19-4 in a closed state).

As can readily be appreciated, because bag 45 has an essentially uniform width and inside dimension over its length and, yet, is used to define, among other things, both the inside and outside walls of insert 31, bag 45 must be sized so that its inside dimension is at least as great as the outside dimension defined by the cavity of machine 50. However, one consequence of sizing bag 45 to have such a large inside dimension is that the portion of bag 45 mounted on top of the inverted box 51 contains left-over material and does not conform closely to the shape of box 51. In fact, said portion is substantially larger than box 51 and results in the formation of some folds in insert 31. Notwithstanding the above, it is not believed that such folding substantially adversely affects the performance of insert 31 (as would be the case if a flat sheet were simply bunched into a forming machine in the conventional manner) or outweighs the financial benefit of using bag 45, which is relatively inexpensive as compared to a specially-tailored bag. However, to reduce the amount of folding attributable to the use of bag 45, one may use one or more strips of adhesive tape or the like to tape down the excess material of bag 45 so that bag 45 more closely conforms to the shape of box 51.

Container 11 may be used in the conventional manner to ship goods. For example, goods may be placed in cavity 53 of box 51, preferably together with dry ice or some other temperature stabilizing unit. Member 61 is then inserted into the open end of cavity 53, and flaps 21-1 through 21-4 are then closed. When container 11 is no longer needed, insert 31 can easily be removed from boxes 13 and 51, and boxes 13 and 51 are thus rendered amenable for recycling or reuse.

In another embodiment (not shown), inner box 51 is eliminated, and insert 31 is formed directly over the plug member of the forming machine.

Figure 6:
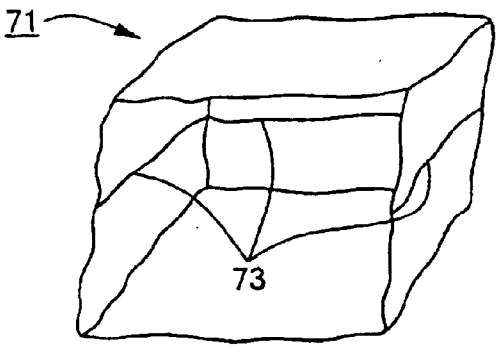
FIG. 6 is a perspective view of an alternative plastic bag to the plastic bag of FIGS. 5(*a*) and 5(*b*)

In still another embodiment (see FIG. 6), bag 45 is replaced with a thin, flexible, non-self-supporting, un-foamed polymer bag 71 defining a rectangular prismatic cavity, bag 71 being formed by joining together two matching rectangular sheets along three of their four matching edges using a single continuous seam 73.

Figure 7:
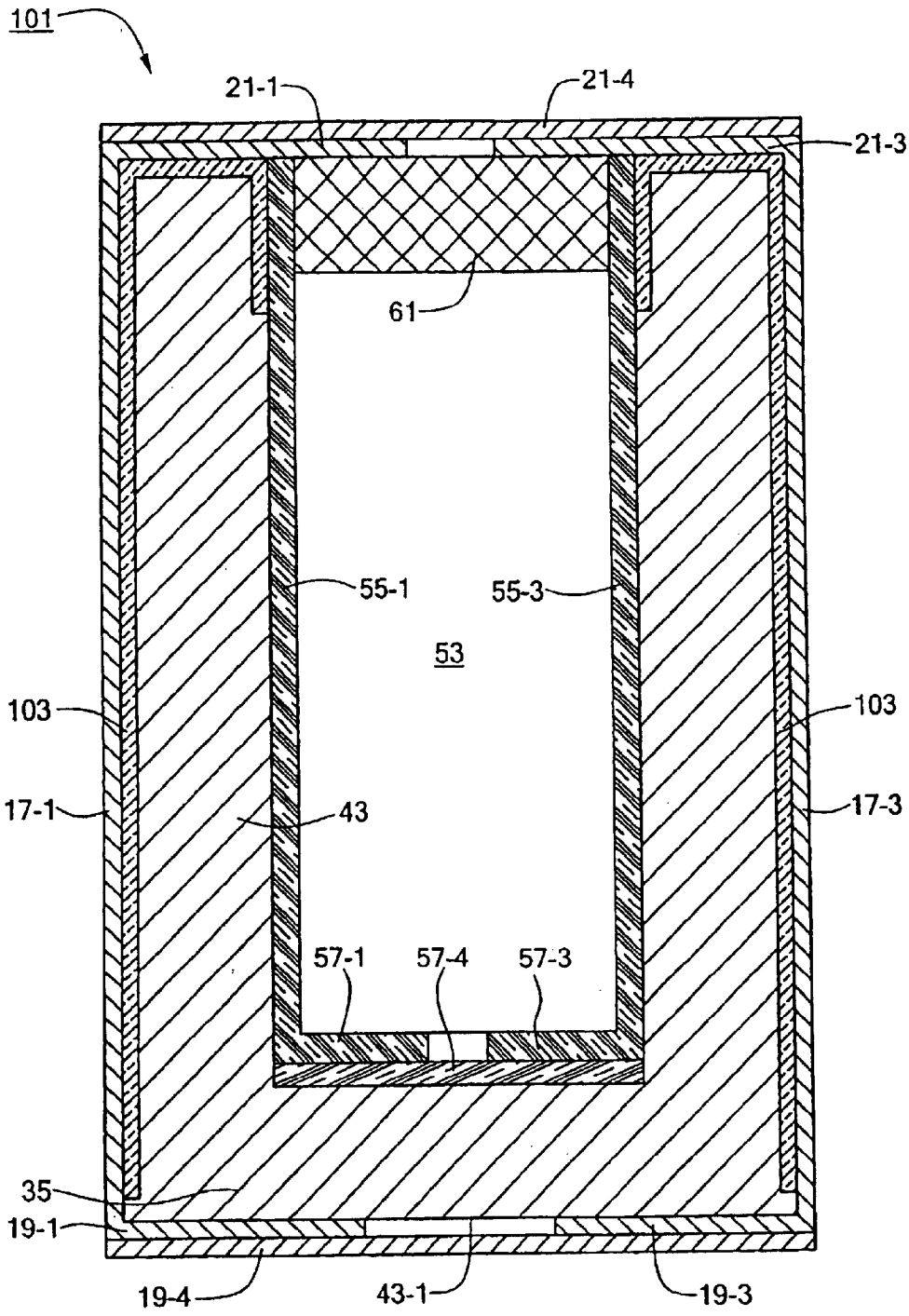
FIG. 7 is a longitudinal section view of a second embodiment of an insulated shipping container constructed according to the teachings of the present invention.

Referring now to FIG. 7, there is shown a longitudinal section view of a second embodiment of an insulated shipping container constructed according to the teachings of the present invention, said insulated shipping container being represented generally by reference numeral 101.

Container 101 is similar in many respects to container 11, the principal differences between the two containers being that bag 45 of container 11 is replaced with a sheet 103 in container 101, sheet 103 being secured to inner box 51 with strips of adhesive tape (not shown).

Figure 8:
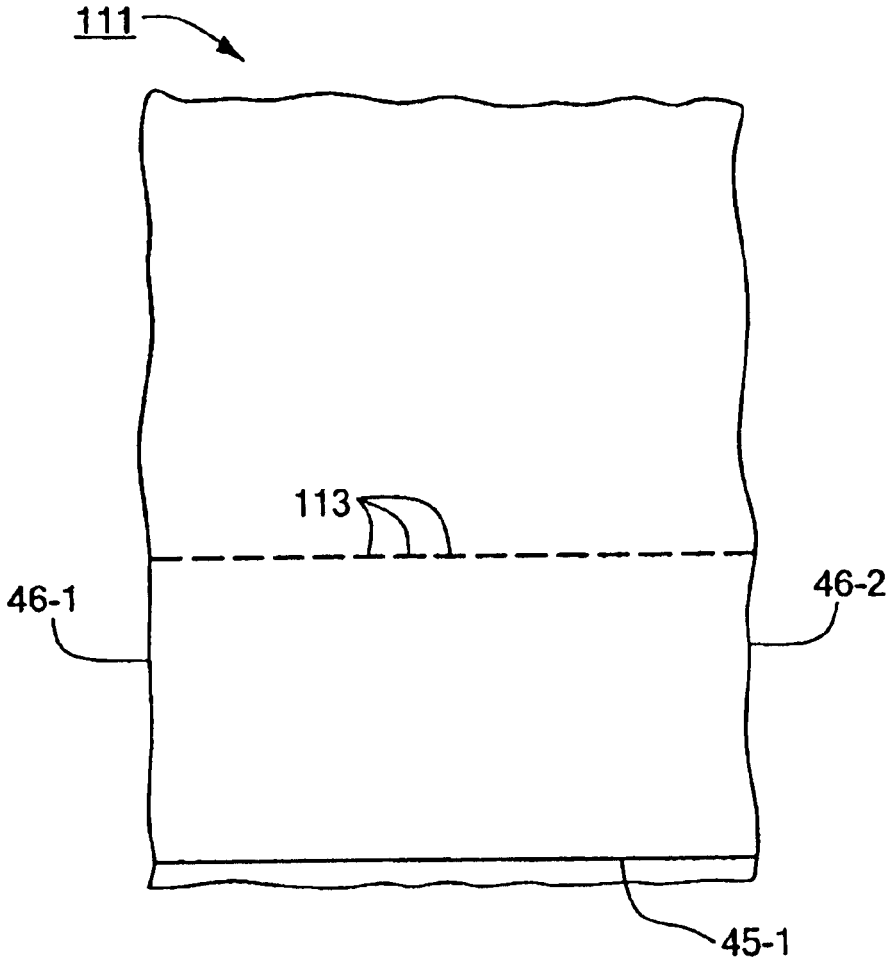
FIG. 8 is a front view of the plastic bag used in the manufacture of the insulated shipping container of FIG. 7.

Referring now to FIG. 8, there is shown a bag 111 used to form sheet 103. As can be seen, bag 111 is virtually identical to bag 45, the only difference between the two bags being that bag 111 is additionally provided with a plurality of perforations 113 peripherally arranged at an intermediate location thereof. Bag 111 is used much like bag 45 and is mounted over a box 51 which has previously been mounted over the plug member of a forming machine, such as machine 50 of U.S. Pat. No. 5,897,017. Next, bag 111 is drawn around the inner cavity of the forming machine and is then torn along perforations 113 to yield sheet 103, perforations 113 being located just above where the open end of box 51 is situated therebeneath. Adhesive tape or other suitable means is then used to secure sheet to box 51. The remaining steps for constructing container 101 are the same as for container 11.

As can readily be appreciated, because a portion of the foamed polymer material 43 of container 101 comes into direct contact with and bonds to box 51, box 51 of container 101 cannot as readily be recycled as is the case with box 51 of container 11.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. An insulated shipping container comprising:

(a) an outer box;

(b) an insulated insert, said insulated insert being slidably removably disposed within said outer box, said insulated insert comprising (i) a foamed polymer body shaped to define a rectangular prismatic cavity bounded by four rectangular side walls and a bottom wall, said foamed polymer body having an open top end, and (ii) a flexible, un-foamed polymer bag, said flexible, un-foamed polymer bag having an open end, a closed end and a generally uniform width over its length from said open end to said closed end and being integrally bonded to said foamed polymer body along said rectangular prismatic cavity, said open top end and said four rectangular side walls, wherein said generally uniform width of said flexible, un-foamed polymer bag is sized to be approximately equal to the outer dimension of said foamed polymer body; and (iii) wherein each of said foamed polymer body and said flexible, un-foamed polymer bag is in direct contact with said outer box and (c) an inner box, said inner box being slidably removably disposed within said insulated insert, said inner box being in direct contact with said flexible, un-foamed polymer bag.

2. The insulated shipping container as claimed in claim 1 wherein said outer box is made of a material selected from the group consisting of corrugated fiberboard and corrugated plastic.

3. The insulated shipping container as claimed in claim 1 wherein said inner box is made of a material selected from the group consisting of corrugated fiberboard and corrugated plastic.

4. The insulated shipping container as claimed in claim 1 wherein each of said outer box and said inner box is made of a material selected from the group consisting of corrugated fiberboard and corrugated plastic.

5. The insulated shipping container as claimed in claim 4 wherein said outer box is shaped to define a rectangular prismatic cavity bounded by four rectangular side wall, four top closure flaps and four bottom closure flaps.

6. The insulated shipping container as claimed in claim 5 wherein said inner box is shaped to define a rectangular prismatic cavity bounded by four rectangular side walls and four bottom closure flaps, the top end of said inner box being open.

7. The insulated shipping container as claimed in claim 1 wherein said flexible, un-foamed polymer bag is a unitary member having a transverse seam at said closed end thereof and a pair of longitudinal creases extending from opposite ends of said transverse seam.

8. The insulated shipping container as claimed in claim 7 wherein said flexible, un-foamed polymer bag is formed by sealing one end of a generally tubular member to itself with a transverse seam and forming a pair of longitudinal creases on opposite ends of said transverse seam.

9. The insulated shipping container as claimed in claim 7 wherein said flexible, un-foamed polymer bag is made of a material selected from the group consisting of hexene and polyethylene.

10. The insulated shipping container as claimed in claim 1 wherein said inner box has an open top end, said insulated shipping container further comprising a closure member snugly, but removably, disposed within said open top end of said inner box.

* * * * *